United States Patent [19]

Hellsten

[11] 4,058,489

[45] Nov. 15, 1977

[54] DETERGENT COMPOSITION HAVING TEXTILE SOFTENING AND ANTISTATIC EFFECT

[75] Inventor: Karl Martin Edvin Hellsten, Odsmal, Sweden

[73] Assignee: Berol Kemi AB, Stenungsund, Sweden

[21] Appl. No.: 577,535

[22] Filed: May 15, 1975

[30] Foreign Application Priority Data

May 20, 1974 Sweden ..... 7406698

[51] Int. Cl.[2] ..... C11D 1/38; C11D 3/26; C11D 7/32

[52] U.S. Cl. ..... 252/547; 252/8.75; 252/8.8; 252/135; 252/528; 252/540

[58] Field of Search ..... 252/8.8, 8.75, 547, 252/528, 540

[56] References Cited

U.S. PATENT DOCUMENTS 2,950,255 8/1960 Goff ..... 252/547

FOREIGN PATENT DOCUMENTS 818,419 7/1969 Canada ..... 252/528

873,214 7/1961 United Kingdom ..... 252/8.75

*Primary Examiner*—Mayer Weinblatt

[57] ABSTRACT

A detergent composition is provided having good cleaning effectiveness while simultaneously imparting to the material treated a soft feel and/or good conductivity for static electricity, and comprising a mixture of surfactants of which:

a. from 30 to 90% by weight is a surfactant selected from the group consisting of nonionic surfactants, amphoteric surfactants, and mixtures thereof; and b. from 10 to 70% by weight is a surfactant mixture comprising at least one anionic surfactant and at least one cationic surfactant in a charge ratio anionic surfactant to cationic surfactant within the range from about 0.60 to about 0.90, suitably within the range from 0.70 to 0.95, and preferably within the range from about 0.75 to about 0.90.

16 Claims, No Drawings

DETERGENT COMPOSITION HAVING TEXTILE SOFTENING AND ANTISTATIC EFFECT

There has long been a need for detergent compositions which, in addition to a good cleaning effectiveness, also have softening and antistatic properties. A number of compositions of varying formulations have been proposed for the purpose. It has been suggested that a softening effect can be imparted to detergent compositions of which the surface active component is a nonionic, anionic or amphoteric compound, by the addition of the quaternary ammonium compounds containing preferably two long alkyl chains that are useful for softening purposes in connection with the final rinsing of textile materials. Other softening additives for detergent compositions are tertiary amines, amine oxides and amino-carboxylic acids, as well as carboxylic acids in which the carboxylic group is attached to a secondary or tertiary carbon atom. However, such detergent compositions do not fully achieve the objective, because they give either a good cleaning effectiveness combined with a poor softening and antistatic effect, or vice versa. Thus, their combination of properties is unsatisfactory, and therefore these detergent compositions have not achieved commercial success.

German Offenlegungsschrift (DOS) No. 1,954,292 discloses a detergent composition containing a combination of nonionic, cationic and anionic surfactants, of which at least 50% of the nonionic surfactant is amine oxide, the anionic surfactant comprising at most 54% of the composition, and the cationic surfactant being a quaternary ammonium textile softening agent. The charge ratio of anionic surfactant to cationic surfactant is at most 0.54. Since amine oxides have a weak cationic nature and the textile softening agent a pronounced cationic nature, such detergent mixtures behave as a mixture of nonionic and cationic surfactants. Such mixtures have a rather poor washing effectiveness for pigment soil, for the reason that the cationic surfactants impart a positive charge to textile fibers and pigments. In consequence, the magnitude of the negative charge, mainly resulting from the hydroxyl ions absorbed onto the fibers, is decreased.

It is also known that the adsorption on cellulose fibers of a cationic softening agent is reduced if the charge ratio of the anionic compound to cationic compound is equal to or greater than 1. Thus, in order to obtain a good softening effect in a detergent composition, a charge ratio of less than 1 is required. This however is the opposite of the ratio required for good washing effectiveness, which is equal to or greater than 1.

According to the present invention a detergent composition is provided which imparts not only a good antistatic effect and a good softening effect, but also has a washing effectiveness comparable to that of the best commercial detergent compositions.

The detergent composition of the invention comprises a mixture of surfactants of which:

a. from 30 to 90% by weight is a surfactant selected from the group consisting of nonionic surfactants, amphoteric surfactants, and mixtures thereof; and b. from 10 to 70% by weight is a surfactant mixture comprising at least one anionic surfactant and at least one cationic surfactant in a charge ratio anionic surfactant to cationic surfactant within the range from about 0.60 to about 0.90, suitably within the range from 0.70 to 0.95, and preferably within the range from about 0.75 to about 0.90.

The charge ratio is calculated in terms of the amount of surfactant ion carrying a charge of 1 Faraday.

The reason why the detergent compositions of the invention simultaneously give a cleaning and softening and/or antistatic effect is not completely known. However, it can be noted that the amount of cationic surfactant adsorbed on the substrate at a charge ratio of 0.9 is twice the amount adsorbed at a charge ratio of 0. At charge ratios of about 1.0 and about 1.2, the amount of cationic surfactant adsorbed is about 25% and 0%, respectively, of that at a charge ratio of about 0.9. Since the amount of cationic surfactant adsorbed is very large, within the range indicated, the detergent compositions of the invention will impart to textile material of cellulosic fibers a soft feel and to textile material of polyamide and polyester fibers a good conductivity for electricity, i.e. antistatic effect.

The cleaning effectiveness of the detergent compositions can mainly be attributed to nonionic or amphoteric surfactant. As previously stated, it is known that nonionic surfactants in combination with cationic surfactants show a poor washing effectiveness. On the other hand, a detergent composition containing anionic surfactants in combination with nonionic or amphoteric surfactants shows a very good washing effectiveness, since the anionic surfactants cooperate with the hydroxyl ions, and increase the negative charge, and thus the repulsion between soil and fibers.

According to the invention, it has been shown that a very good washing effectiveness is obtained at a charge ratio from about 0.60 to about 0.98, suitably from about 0.70 to about 0.95, preferably from 0.75 to 0.90, of anionic surfactant to cationic surfactant, which is within the range where one would expect to find a rather poor washing effectiveness. Washing tests show that as the charge ratio of anionic to cationic surfactant decreases to about 0.6, the detergent compositions show an essentially unchanged washing effectiveness.

In certain cases, at a charge ratio of between about 0.7 to about 0.85, a washing effectiveness may be obtained that is better than those obtained with a high content of anionic surfactant. On the other hand, as the charge ratio decreases below 0.6, the washing effectiveness decreases rapidly.

Thus, according to the invention, detergent compositions are provided containing nonionic and/or amphoteric surfactants as well as anionic and cationic surfactants in definite amounts that have a good cleaning effectiveness, together with a softening and/or antistatic effect.

The total amount of surfactant is suitably within the range from about 5 to about 30% by weight, preferably from 8 to 20% by weight.

The detergent composition can be in solid form, in liquid form, or in the form of a paste.

According to the invention the nonionic surfactant can be any nonionic surfactant having a good washing effectiveness.

One preferred class of nonionic surfactants can be defined by the formula:

$$RA\,[C_nH_{2n}O]_xH \qquad \text{I}$$

wherein

R is a hydrocarbon group having from about eight to about thirty carbon atoms, including alkyl, alkenyl, cycloalkyl, alkyl phenyl, and alkyl naphthyl;

A is selected from the group consisting of oxygen, sulfur, amido, carboxylic acid, sulfoxide and sulfonic groups;

$n$ is a number from 2 to 4; and $x$ is a number from 4 to about 40.

Exemplary are the alkylene oxide adducts of monoalkyl phenols, dialkyl phenols, fatty alcohols, secondary alcohols, fatty acids, fatty acid amides and alkyl mercaptans, as well as hydroxyl-containing alkyl sulphides, alkyl sulphoxides and alkyl sulphones, in which compounds the total number of carbon atoms in the hydrocarbon part is from eight to twenty two carbon atoms, and the polyalkylene glycol chain has from four to forty alkylene glycol groups of from two to four carbon atoms.

Especially preferred are the nonionic surfactants having the general formula:

$$R_1O(C_2H_4O)_{p1}(C_nH_{2n}O)_{p2}H \qquad \text{II}$$

wherein $R_1$ represents an aliphatic or cycloaliphatic group having from about eight to about twenty two, preferably from about eight to about fourteen carbon atoms, or a mono- or dialkyl phenyl group having a total of from about four to about twenty four, preferably from about eight to about eighteen carbon atoms in the alkyl groups;

$n$ is 3 or 4;

$p_1$ is a number from about 4 to about 40, preferably from about 5 to about 12, when R is an aliphatic or cycloaliphatic group, and from about 6 to about 18, when R is a mono- or dialkyl phenyl group; and $p_2$ is a number from 0 to about 5, preferably from 0 to about 3.

Specific examples of suitable nonionic surfactants comprised by Formula II are ethylene oxide adduct, mono and diethers of decyl alcohol, lauryl alcohol, myristyl alcohol, cetyl alcohol, stearyl alcohol, eicosyl alcohol, oleyl alcohol, cyclooctanol, cyclododecanol, cyclohexadecanol, octyl phenol, nonyl phenol, dodecyl phenol, hexadecyl phenol, dibutyl phenol, dioctyl phenol, and dinonyl phenol.

Other suitable nonionic surfactants are alkylene oxide adducts of natural or synthetic carboxylic acids and alkyl mercaptans, represented by the general formula:

$$RA(C_2H_4O)_{p1}(C_nH_{2n}O)_{p2}H$$

wherein

R and $n$, $p_1$ and $p_2$ are as defined above and

A is selected from the group consisting of oxygen, sulphur,

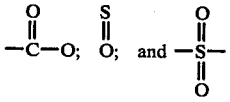

Suitable nonionic surfactants are the alkylamido alkylene oxide adducts of the general formula:

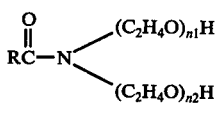

wherein

R is as defined above and $n_1$ and $n_2$ are numbers from about 4 to about 40.

A further class of nonionic surfactants are the so-called block copolymers, containing blocks of additional polymers of ethylene oxide, propylene oxide, and optionally butylene oxide. The molecular weight of the propylene or alternatively the butylene oxide part or parts should be within the range from about 1000 to about 4000 while the polyethylene oxide part or parts have a molecular weight within the range from about 500 to about 2000.

If desired, the nonionic surfactants in whole or in part may be replaced by ampholytic (sometimes referred to as "Zwitterionic") surfactants having good cleaning properties. Especially suitable are mixtures of nonionic and ampholytic surfactants in a weight ratio of from about 1:5 to about 5:1.

Preferred ampholytic surfactants are those containing a quaternary nitrogen atom. Examples of such compounds are the compounds of the betaines and sulphobetaines having the general formulae:

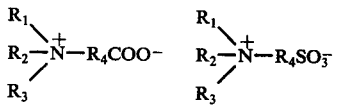

In these formulae $R_1$, $R_2$ and $R_3$ represent alkyl groups having from one to about twenty two carbon atoms, alkyl phenyl groups wherein the alkyl has from one to about eighteen carbon atoms, and $R_4$ is a bivalent hydrocarbon group having from one to about twenty two carbon atoms, suitably having from one to about eight carbon atoms in the carbon chain joining the nitrogen with the carboxylic or sulphonic acid groups, and preferably not having more than three carbon atoms in that chain.

Another class of ampholytic surfactants having quaternary nitrogen and having very good properties is that of the general formula:

$$RO(C_{p1}H_{2p_1}O)_{n1}(C_{p2}H_{2p_2}O)_{n2}(C_{p3}H_{2p_3}O)_{n3}CH_2CH(OH)CH_2N^+R_1R_2C_qH_{2q}COO^-$$

wherein

R represents an aliphatic or cycloaliphatic group having from about six to about twenty two carbon atoms or an aromatic group substituted by one or more alkyl groups having a total of from about four to about eighteen carbon atoms in the alkyl groups;

$R_1$ and $R_2$ are alkyl groups having from one to about three carbon atoms;

$p_1$, $p_2$ and $p_3$ are 2, 3 or 4;

$n_1$, $n_2$ and $n_3$ are numbers from 0 to 10, the sum of $n_1$, $n_2$ and $n_3$ not exceeding 10; and $q$ is 1, 2 or 3.

These surfactants have a good solubility in water, and a good cleaning effectiveness. The compounds wherein nitrogen atoms and carboxylic groups are attached to the same carbon atom and wherein $q$ preferably is 1 possess especially good properties. Further, generally preferred are compounds wherein $p_1$, $p_2$ and $p_3$ are 2 or wherein $n_1$, $n_2$ and $n_3$ are 0. Valuable compounds within this class are disclosed in the Belgian Pat. No. 807,895.

Other useful ampholytic surfactants are those containing a secondary or tertiary nitrogen atom. Examples of such compounds are monoalkylamino monocarboxylic acids, monoalkylamino dicarboxylic acids and dialkylamino monocarboxylic acids, of the general formulae:

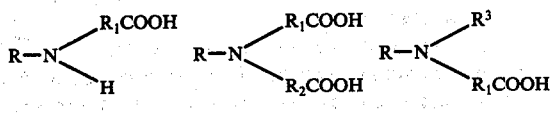

wherein

R is an alkyl group having from about ten to about twenty two carbon atoms, or an alkyl phenyl group wherein the alkyl group has from about one to about eighteen carbon atoms;

$R_1$ and $R_2$ are bivalent hydrocarbon groups having from one to about eight carbon atoms;

$R_3$ is an alkyl group having from one to about twelve carbon atoms; or a salt thereof with an alkali metal, alkaline earth metal, ammonia or an amine.

Commonly occurring compounds with said classes are dodecylamino acetic acid, cetylamino acetic acid, oleylamino acetic acid, dodecylamino diacetic acid, cetylamino diacetic acid, N-methyl-N-dodecylamino acetic acid, N-methyl-N-cetylamino acetic acid, N-methyl-N-octylamino acetic acid, N,N-dihexylamino acetic acid, N,N-dioctylamino acetic acid, N,N-dinonylamino acetic acid, and N,N-didoceylamino acetic acid.

A further class of ampholytic surfactants that can be used advantageously are substituted imidazoline carboxylates. They are primarily used together with nonionic surfactants, since in rather small amounts they raise the turbidity point of nonionic surfactants. Owing to this, the risk of precipitation of nonionic surfactants and loss of washing effectiveness is reduced.

The structure of these imidazoline derivatives is in doubt, but usually they are represented by the general formula:

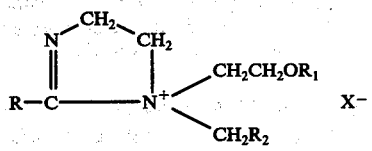

wherein

R is a straight or branched saturated or unsaturated aliphatic group having from about eight to about twenty two carbon atoms;

$R_1$ is hydrogen or a carboxyl-containing alkyl group;

$R_2$ is a carboxyl-containing alkyl group or a sulphonic acid-containing alkyl group; and $X^-$ is a negatively charged ion, or a salt thereof.

Further, it should be noted that unbalanced ampholytic surfactants also can be used in the compositions of the invention, but they must then be included in the anionic or cationic surfactant, according to the charge ratio.

Principally, the anionic surfactant can be selected independently from known anionic surfactants. Some of the most important kinds of compounds concerned are those of the formulae:

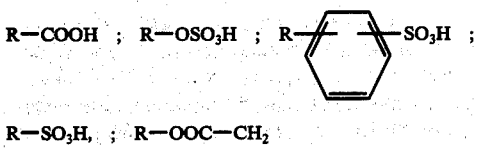

-continued

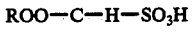

wherein

R represents a hydrocarbon group having from about eight to about twenty two carbon atoms; or a salt thereof with an alkali metal, alkaline earth metal, or ammonium compound, or amine. Among the anionic surfactants mention can especially be made of alkyl aryl sulphonates of the general formula:

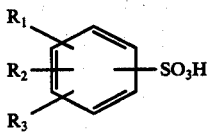

wherein $R_1$, $R_2$ and $R_3$ independently represent an alkyl group having from one to about eighteen carbon atoms or hydrogen, the total number of carbon atoms in the alkyl groups being from about six to about twenty two; or a salt thereof with an alkali metal, alkaline earth metal, or ammonia, or an amine. Exemplary are sodium polypropylene benzene sulfonate and sodium keryl benzene sulfonate.

Other very suitable anionic surfactants are the alkyl sulphates, which can be represented by the general formula:

$R\text{-}OSO_3H$ wherein

R is a straight or branched saturated or unsaturated aliphatic group having from about ten to about twenty two carbon atoms; or a salt thereof with an alkali metal, alkaline earth metal, ammonia or an amine. Specific examples of alkyl sulphates are sodium lauryl sulphates, sodium myristyl sulphate, sodium stearyl sulphate, and sodium oleyl sulphate.

The preferred anionic surfactants of the invention are ether sulphates and ether phosphates of the general formulae:

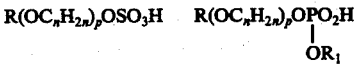

wherein

R is a straight or branched saturated or unsaturated aliphatic group having from about eight to about twenty two carbon atoms, a mono- di- or tri- alkyl-substituted phenyl group having a total from about six to about eighteen carbon atoms in the alkyl groups, or an alkylcycloalkyl or cycloalkyl group having a total from about eight to about twenty two carbon atoms;

$(OC_nH_{2n})_p$ represents an alkylene glycol chain where $n$ represents the integers 2, 3 and/or 4 and $p$ is a number from 1 to 10; and $R_1$ represents hydrogen or any of the groups R and $R(OC_nH_{2n})_p$ defined above; or a salt thereof with an alkali metal, alkaline earth metal, ammonia or an amine.

By varying R and the length of the alkylene glycol chain as well as the alkylene oxide units present in the alkylene glycol chain the hydrophilic/lipophilic balance can be adapted to any specific detergent composition desired. When combined with nonionic and cationic surfactants in the amount defined, the ether phosphates and the ether sulphates impart to the detergent compositions excellent foam suppressant properties. Moreover, the ether phosphates have an advantageous corrosion inhibiting and solubilizing capacity.

Suitable cationic surfactants are those having a softening effect. In addition to this, the compounds usually being nitrogen-containing compounds having at least one long hydrophobic chain should be soluble or dispersible in water.

Preferred cationic surfactants are quaternary ammonium compounds containing at least one, preferably two, hydrophobic groups having from about six to about twenty two carbon atoms. Examples of such compounds are those of the general formula:

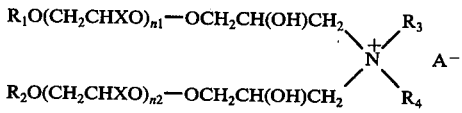

wherein $R_1$ and $R_2$ are straight or branched, saturated or unsaturated aliphatic groups having from about six to about twenty two carbon atoms, or a mono-, di- or tri- alkyl-substituted phenyl group having a total of from about six to about eighteen carbon atoms in the alkyl groups, or an alkyl cycloalkyl group containing a total of from about eight to about twenty two carbon atoms;

X is hydrogen or methyl or ethyl;

$R_3$ and $R_4$ are methyl or ethyl; and $n_1$ and $n_2$ are numbers from 0 to 5.

Compounds comprised by this formula are disclosed in the Belgian Pat. No. 791,118.

Other suitable quaternary ammonium compounds are those of the general formula:

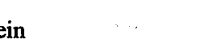

wherein $R_1$ and $R_2$ are as defined above; and

X represents halogen, $CH_3SO_4$ or $\frac{1}{2}$ $SO_4$.

In addition to the above-stated nonionic, anionic and cationic surfactants, the detergent compositions of the invention may contain other components which are customary in detergent compositions, such as corrosion inhibitors, complexing agents, neutral builder salts, buffer substances, soil-suspending agents, polar solvents, optical brightening agents, coloring agents and pigments, perfumes, foam suppressants, stabilizers, protective colloids and biocidal agents.

Inorganic and organic complexing agents are added in order to improve the soil-removing capacity, especially when the goods are heavily soiled. The amount of complexing agent usually is within the range from 0 to about 50% by weight of the composition, preferably within the range of from about 10 to about 30% by weight.

Alkali metal polyphosphates are especially suitable for use in the preparation of so-called heavy-duty detergents, and in order to improve the properties of the detergent composition in hard water. Such polyphosphates comprise sodium diphosphate, potassiim diphosphate, pentasodium triphosphate, sodium triphosphate, pentapotassium triphosphate, tetrasodium and tetra potassium diphosphate, sodium tetraphosphate, sodium hexamethaphosphate and pentaammonium triphosphate.

Due to their buffering properties, alkali metal silicates, alkali metal borates and alkali metal carbonates are used alone or in admixture with polyphosphates. Examples of such compounds are sodium metasilicate, borax and sodium carbonate.

Valuable organic complexing agents are i.a. alkali metal, ammonium and organic amine salts of polyamino carboxylic acids, e.g. mono-, di-, tri-, and tetra-sodium salts of ethylene diamine tetraacetic acid, mono-, di-, and tri-sodium salts of nitrilo triacetic acid, and sodium salts of N-hydroxyethyl ethylene diamine triacetic acid, N-hydroxyethyl imino diacetic acid and diethylene triamine pentaacetic acid; salts of oxycarboxylic acids, such as citric acid, oxydiacetic acid and gluconic acid; and salts of unsaturated polycarboxylic acids, such as polymaleic acid, polyitaconic acid, 1,2,3,4-tetracarboxy cyclopentane, and polyacrylic acid.

These compounds are similar to the inorganic complexing agents in their ability to form complexes with hardness-forming metal ions in aqueous solutions. Therefore, they are especially valuable when the detergent composition is used in water of normal or high hardness. The amount of organic builder salts is usually from about 5 to about 40%, preferably from about 10 to about 30% by weight of the composition.

Neutral builder salts, such as sodium sulphate and potassium sulphate, are formed when neutralizing sulphate ester or sulphonate ester detergents, and are usually present in admixture with such detergents. Further addition of such sulphates can be made in order to formulate or extend the composition.

Soil-suspending agents may also be added, especially in formulating heavy-duty detergents. Suitable soil-suspending agents are sodium carboxymethyl cellulose, sodium cellulose sulphate, lower alkyl and hydroxyalkyl cellulose ethers, such as ethyl hydroxyethyl cellulose, ethyl hydroxypropyl cellulose, and hydroxyethyl cellulose, as well as polyvinyl alcohol and polyvinyl pyrrolidone. Soil-suspending agents are usually used in amounts of from about 0.05 to about 5%, preferably from about 0.1 to about 2%, calculated on the amount of solids.

As previously stated the detergent compositions may be in liquid form, as a paste, or in solid form. To formulate the detergent composition as a paste or liquid, water or a water-soluble organic solvent must be added, the organic solvent usually being an alcohol, polyol or alkyl ether glycol having a low viscosity, i.e., readily flowing or mixtures of such solvents. Examples of suitable solvents are ethanol, n-propanol, isopropanol, ethylene glycol, diethylene glycol, and higher polyethylene glycols having a molecular weight of from about 108 to about 400, propylene glycol, dipropylene glycol, and polypropylene glycols having a molecular weight of from about 136 to about 4000, butylene glycol, hexylene glycol, ethylene glycol monoethyl ether, diethylene glycol monoethyl ether, and glycerol. The total amount of solvent normally is within the range from about 10 to about 90, preferably from about 30 to about 79%, by weight of the detergent composition. Liquid detergent compositions of especially high stability and having good cleaning effectiveness are obtained if the surfactant component a) is a combination of a nonionic and an ampholytic surfactant.

Other additives are bleaching agents, such as sodium perborate, sodium percarbonate, sodium perdiphosphate and potassium persulphate; corrosion inhibitors, such as sodium aluminate and sodium zincate; and other components, such as coloring agents, brightening agents and foam suppressants.

The following Examples in the option of the inventor represent preferred embodiments of his invention:

EXAMPLE 1

In a laboratory Terg-O-Tometer type washing machine, artificially soiled cotton fabric from Waschereiforschung, Krefeld (WFK) was washed at 85° C in water of 15° dH for 15 minutes. As the washing agent the detergent compositions noted in Table I were used. Detergent compositions A to E of which A was a common commercial detergent composition, were included for comparison purposes. The different detergent compositions were added in an amount of 7 grams per liter of washing solution, and their formulations were as follows (in % by weight of the dry weight of the composition):

TABLE I

| DETERGENT COMPOSITION | % by weight | | | | | |
|---|---|---|---|---|---|---|
| | Controls | | | | | Example |
| | A | B | C | D | E | 1 |
| Sodium dodecyl benzene sulphonate | 5 | — | — | — | — | — |
| Sodium tallow fatty acid soap | 6.5 | — | — | — | — | — |
| Fatty alcohol polyglycol ether ($C_{14-20}$fatty alcohol + 8 ethylene oxide units) | 6.5 | 10 | 10 | 10 | 10 | 10 |
| Alkyl polyglycol ether sulphate ($C_{16-18}$ alcohol + 2 ethylene oxide units + sulphate) | — | 3 | 3 | 3 | 3 | 3 |
| Quaternary ammonium compound $[C_{10}H_{21}OCH_2CH(OH)CH_2]_2N^+(CH_3)_2Cl^-$ | — | — | 1.7 | 2.3 | 3.4 | 4.2 |
| $Na_5P_3O_{10}$ | 30 | 30 | 30 | 30 | 30 | 30 |
| Na-silicate, Na-perborate Na-sulphate, Na-carboxymethyl cellulose | ← BALANCE → | | | | | |
| Charge ratio anionic surfactant to cationic surfactant | — | ∞ | 2 | 1.5 | 1.0 | 0.8 |

The brightness of the test fabric was measured by reflection measurement in a Zeiss' Elrepho photometer, and the measurements were converted to black content according to the Kubelka-Munk formula:

$$K/S = \frac{(95 - R)^2}{2R}$$

wherein

R is the reflectance expressed in percent of the reflectance of magnesia.

The following results were obtained:

TABLE II

| DETERGENT COMPOSITION | A | B | C | D | E | EX. 1 |
|---|---|---|---|---|---|---|
| Washing effectiveness as percentage black content removed | 78.4 | 80.7 | 80.3 | 80.5 | 83.1 | 81.8 |

The washing results for the detergent composition according to the invention shows that it is quite possible to achieve a good washing effectiveness even if the charge ratio of anionic to cationic surfactant is less than 1.

The softening effectiveness of the detergent compositions concerned was tested by washing a white cotton terry fabric in towel size pieces in a cylinder washing machine of 4 kgs capacity using a colored-cloth washing program with a maximum temperature of 60° C. The detergent composition used was added in an amount of 7 grams per liter and the hardness of the water was 15° dH. Upon washing and drying of the terry fabric the softness was estimated subjectively by test panel members independently of each other. The panel members ranked the fabric pieces according to softness, the softest fabring receiving 6 points and the hardest 1 point. The values listed in Table III below are averages of said estimates.

TABLE III

| DETERGENT COMPOSITION | A | B | C | D | E | EX. 1 |
|---|---|---|---|---|---|---|
| Ranking number | 1.2 | 3.9 | 2.0 | 2.9 | 5.0 | 6.0 |

Fabric treated with the detergent composition according to the invention was considered softest by everyone in the test panel. From the results obtained, it is evident that detergent composition in accordance with the invention shows a very good softening as well as cleaning effect.

EXAMPLES 2 to 4

In a series of washing tests the seven detergent compositions whose formulation is given in Table IV were tested. Examples 2 to 4 were in accordance with the invention. First the cleaning effectiveness was examined using the same method as described in Example 1 but with the exception that the detergent compositions were added in an amount of 4 grams per liter washing solution. The softening effect of the different detergent compositions was determined by washing cotton terry fabric at 60° C in a cylinder machine of 4 kgs capacity. The detergent concentration was 4 grams per liter and the water hardness was 5° dH. The towel size cotton terry pieces were hung dry at about 30° C whereupon test panel members independently of each other were allowed to rank the pieces according to their subjective estimate of the feel of the fabric. The softness was ranked according to a scale from 1 to 7 where 1 is the hardest feel and 7 is the softest feel. The following results were obtained:

TABLE IV

| DETERGENT COMPOSITION | % by weight | | | | | | |
|---|---|---|---|---|---|---|---|
| | Controls | | | | Examples | | |
| | A | F | G | H | 2 | 3 | 4 |
| Sodium dodecyl benzene sulphonate | 5 | — | — | — | — | — | — |
| Sodium tallow fatty acid soap | 6.5 | — | — | — | — | — | — |

TABLE IV-continued

| DETERGENT COMPOSITION | % by weight | | | | | | |
|---|---|---|---|---|---|---|---|
| | Controls | | | | Examples | | |
| | A | F | G | H | 2 | 3 | 4 |
| Fatty alcohol glycol ether ($C_{8-14}$ fatty alcohol + 7 ethylene oxide + 1 propylene oxide) | 6.5 | 9 | 9 | 9 | 9 | 9 | 9 |
| Alkyl polyglycol ether sulphate ($C_{16-18}$ alcohol + 2 ethylene oxide + sulphate) | — | 2.0 | 2.25 | 2.37 | 1.37 | 1.50 | 1.75 |
| Quaternary ammonium compound $[C_{10}H_{21}OCH_2CH(OH)CH_2]_2N^+(CH_3)_2Cl^-$ | — | 2.25 | 2.25 | 2.25 | 2.25 | 2.25 | 2.25 |
| $Na_5P_3O_{10}$ | 30 | 30 | 30 | 30 | 30 | 30 | 30 |
| Na-silicate, Na-perborate, Na-sulphate, Na-carboxymethyl cellulose | ← BALANCE → | | | | | | |
| Charge ratio anionic surfactant to cationic surfactant | — | 1.0 | 1.1 | 1.2 | 0.7 | 0.8 | 0.9 |
| Washing effectiveness | 84.4 | 82.7 | 84.8 | 87.1 | 78.5 | 81.0 | 83.9 |
| Softening effect, average ranking number | 1.0 | 3 | 3 | 3 | 6.6 | 6.1 | 5.3 |

The washing effectiveness of the detergent compositions according to the invention is equal to or only slightly below the effectiveness of the commercial detergent composition A, and the softening effect of the detergent compositions according to the invention is clearly better.

In order to determine to which extent the detergent compositions of the invention are capable of removing fatty soil, the following washing test was carried out. Polyester/cotton fabric was soaked with a petroleum ether solution of isotope-labeled oleic acid triglyceride, and upon evaporation of the petroleum ether the activity of the pieces was determined. Thereupon they were washed at 60° C in a Terg-O-Tometer for 15 minutes in water of 5° dH, were rinsed and dried whereupon the activity was determined once again. The detergent compositions A, and Examples 2 and 3 were used in the washing test and added in an amount 7 grams per liter.

The results in Table V were obtained, the washing effectiveness being expressed as percentage of fat removed.

TABLE V

| DETERGENT COMPOSITION | Control | Examples | |
|---|---|---|---|
| | A | 2 | 3 |
| % of fat removed | 12 | 77 | 77 |

TABLE V-continued

| DETERGENT COMPOSITION | Control | Examples | |
|---|---|---|---|
| | A | 2 | 3 |
| Standard deviation | 2.1 | 4.0 | 2.3 |

From the results, it is evident that the detergent compositions according to the invention have a considerably greater capacity of removing fatty soil than the commercial detergent composition.

EXAMPLE 5

In a cylinder machine of 4 kgs capacity, artificially soiled cotton fabric from Waschereiforschung, Krefeld (WFK) as well as artificially soiled polyester/cotton fabric (65/35) from Testfabrics Inc. were washed using the colored-cloth washing program, the maximum temperature being 60° C and the water hardness being 5° dH. Simultaneously, towel size pieces of white cotton terry fabric were washed, the softness of which was estimated upon drying and washing. As the test detergent composition there was used either Example 5, a detergent composition according to the invention or a detergent composition I according to German Offenlegungsschrift No. 1,954,292.

The formulations of the detergent compositions, expressed in parts by weight, and the results obtained in the washing test, are given in Table VI below:

TABLE VI

| DETERGENT COMPOSITION | Parts by Weight | |
|---|---|---|
| | Example 5 | Control 1 |
| $Na_5P_3O_{10}$ | 30 | 35 |
| $Na_2SO_4$ | 25 | — |
| $Na_2B_2O_6 . 8 H_2O$ | 20 | 20 |
| $Na_2O . 3.3 SiO_2$ | 6 | 4 |
| $MgSiO_3$ | — | 2.5 |
| Sodium carboxymethyl cellulose | 2 | 1.5 |
| Tetrasodium EDTA (ethylene diamine tetraacetic acid) | — | 0.2 |
| Cocoalkyl dihydroxyethyl amine oxide | — | 12 |
| Ditallow dimethyl ammonium chloride | — | 17 |
| Technical grade sodium $C_{12}$-alkyl benzene sulphonate | — | 3 |
| Quaternary ammonium compound $[C_{10}H_{21}OCH_2CH(OH)CH_2]_2N^+(CH_3)_2Cl^-$ | 2.25 | — |
| Alkyl polyglycol ether sulphate ($C_{16-18}$ alcohol + 2 ethylene oxide + sulphate | 1.37 | — |
| Fatty alcohol polyglycol ether ($C_{8-14}$ fatty alcohol + 7 ethylene oxide + 1 propylene oxide) | 9 | — |
| Water | Balance to 100 parts by weight | |
| Charge ratio | 0.7 | 0.3 |
| Amount of detergent composition added | 4 grams/l | 6 grams/l |
| Black content removed (fabric from WKF) | 87.4% | 45.9% |

TABLE VI-continued

| DETERGENT COMPOSITION | Parts by Weight Example 5 | Control 1 |
|---|---|---|
| Black content removed (fabric from Testfabrics) | 54.0% | 14.5% |

When estimating the softness of the cotton terry fabric subjectively, it was found that both detergent compositions give about the same softness. Compared to laundry washed with detergent composition A in Example 1, the softness is considerably higher. Thus, it can be concluded that the detergent composition according to the German Offenlengungsschrift No. 1,954,292 gives a good softening effect, but it has a very poor cleaning effectiveness, compared to the detergent composition according to the invention.

The antistatic effect of Example 5 was tested by washing test swatches of polyamide fabric with compositions A and Example 5 in a cylinder machine of 4 kgs capacity, using the colored-cloth washing program, the maximum temperature being 60° C. Thereupon the test swatches were dried and conditioned at a relative humidity of 65%, and the electrical conductivity of the polyamide fabric was measured in a Rotschild Static Voltmeter where the time required to discharge half the initial voltage (100 volts) between the electrodes was measured in seconds.

In addition a test was carried out with the detergent composition A and Example 5 wherein test swatches of polyamide fabric were subjected to the same washing procedure as above, with the exception that there was added to the last rinsing water a solution of ditallow fatty dialkyl methyl ammonium chloride (DTDMAK) in an amount corresponding to 1 gram of active substance per kilogram of textile dry weight. These tests were designated A + DTDMAK and Example 5 + DTDMAK, respectively. The following results were obtained:

TABLE VII

| DETERGENT COMPOSITION | Control A | Example 5 | A+DTDMAK | Example 5 + DTDMAK |
|---|---|---|---|---|
| Half-life (seconds) | 129 | 38 | 89 | 86 |

In all tests the washing effectiveness was good, and about the same. From the results it is evident that the detergent composition of Example 5 gives a better antistatic effect on polyamide fabrics than a conventional detergent composition, even if, in the latter case, there is added a cationic softener to the last rinse. The addition of the cationic softener to the last rinse water surprisingly results in a pronounced deterioration of the antistatic effect of the detergent composition of the invention.

EXAMPLES 6 and 7

A washing series was carried out under the same test conditions as in Example 5. In addition to artificially soiled fabric of the kinds stated therein, there was used artifically soiled nylon fabric from Testfabrics Inc., as well as cotton fabric soiled with protein-containing soil EMPA 116 from Eidgenossische Materialprufungsanstalt (EMPA), St. Gallen, Switzerland.

The detergent compositions were added in an amount of 5 grams per liter. The test compositions were the commercial detergent composition A from Example 1, the detergent composition from Example 5, a detergent composition Example 6 of the same formulation as Example 5, but with the exception that the 9 parts by weight of fatty alcohol polyglycol ether was replaced by 4 parts by weight of fatty alcohol polyglycol ether (obtained from $C_{12-14}$-fatty alcohol + 8 moles of ethylene oxide, as well as by 4 parts by weight of an ampholytic surfactant of the betaine type having the formula:

$$C_nH_{2n+1}(OC_2H_4)_pOCH_2CH_4.(OH)CH_2N^+(CH_3)_2CH_2COO^-$$

wherein

*n* is the numbers 10 and 16; and

*p* the numbers 0 and 4;

and a detergent composition Example 7 corresponding to the detergent composition of Example 5 with the exception that the 9 parts by weight of fatty alcohol polyglycol ether was replaced by 10 parts by weight of fatty alcohol polyglycol ether of the same kind as in the detergent composition of Example 6. The results obtained are evident from Table VIII below:

TABLE VIII

| DETERGENT COMPOSITION | Control A | Examples 5 | 6 | 7 |
|---|---|---|---|---|
| Black content removed (fabric from WFK) | 87.9 | 87.3 | 93.6 | 52.6 |
| Black content removed (fabric from Testfabrics) | 50.0 | 50.4 | 87.7 | 66.3 |
| Black content removed (nylon) | 92.1 | 85.9 | 95.6 | —[1] |
| Black content removed (fabric from EMPA) | 57.9 | 37.2 | 58.9 | —[1] |
| Softness (cotton terry fabric) | 1.2 | 2.4 | 3.4 | 3.0 |

[1]test not carried out

The softness was estimated and ranked according to a scale where the test piece considered as softest was given the rating 4 and the hardest the rating 1. The values indicated in Table VIII are averages. A comparison of Example 6 with Example 7 shows that the addition of the ampholytic surfactant compound improves the washing capacity as well as the softening effect.

EXAMPLES 8 to 11

A washing series was carried out using the same washing technique as in Example 5. As the test-goods there were used artificially soiled cotton fabric from Waschereiforschung, Krefeld (WFK) as well as pure white cotton terry fabric.

The detergent compositions of Examples 8 to 11 were used, added in an amount of 5 grams per liter. They all had the same weight ratio of anionic and cationic surfactant as Example 5. The formulations and the results obtained in the washing tests were shown in Table IX:

TABLE IX

| DETERGENT COMPOSITION | % by weight Examples 8 | 9 | 10 | 11 |
|---|---|---|---|---|
| Quaternary ammonium compound | 2.25 | — | 2.25 | — |

TABLE IX-continued

| DETERGENT COMPOSITION | % by weight Examples 8 | 9 | 10 | 11 |
|---|---|---|---|---|
| $[C_{10}H_{21}OCH_2CH(OH)CH_2]_2N^+(CH_3)_2Cl^-$ Ditallowalkyl dimethyl ammonium chloride | — | 2.58 | — | 2.58 |
| Alkyl polyglycol ether sulphate ($C_{16-18}$ alcohol + 2 ethylene oxide units + sulphate) | 1.37 | 1.37 | — | — |
| Na-dodecyl benzene sulphonate | — | — | 1.13 | — |
| Na-lauryl sulphate | — | — | — | 1.04 |
| Charge ratio anionic surfactant side to cationic surfactant | 0.81 | 0.81 | 0.81 | 0.81 |
| Black content removed (fabric from WFK) | 90.1 | 88.0 | 89.3 | 88.5 |
| Softness (terry fabric)[1] | 1.0 | 3.3 | 2.7 | 3.0 |

[1]The softness values relate to ranking order and are not scores of any scoring table.

All test samples were considered softer than terry fabric washed with the commercial detergent composition A used in Example 1 In all cases the washing capacity is good.

Having regard to the foregoing disclosure, the following is claimed as the inventive and patentable embodiments thereof:

1. A detergent composition imparting a good antistatic effect and a good softening effect, consisting essentially of a mixture of surfactants of which a. from 30 to 90% by weight is a nonionic surfactant having the formula:

$$RA\ (C_nH_{2n}O)_xH$$

wherein

R is a hydrocarbon group selected from the group consisting of alkyl groups having from about eight to about twenty-two carbon atoms, and mono-alkyl phenyl groups having a total of from about four to about twenty-four carbon atoms in the alkyl groups; and A is selected from the group consisting of oxygen, sulfur, amido, carboxylic acid, sulfoxide and sulfonic groups;

$n$ is a number from 2 to 4; and $x$ is a number from 4 to about 40; and b. from 10 to 70% by weight is a surfactant mixture comprising at least one anionic surfactant and at least one cationic surfactant in a charge ratio anionic surfactant to cationic surfactant within the range from about 0.60 to about 0.98;

the anionic surfactant having the general formula:

$$R(OC_nH_{2n})_pOSO_3H$$

wherein:

R is a hydrocarbon group selected from the group consisting of alkyl groups having from about eight to about twenty-two carbon atoms, and mono-alkyl-substituted phenyl groups having a total from about six to about eighteen carbon atoms in the alkyl groups;

$(OC_nH_{2n})_p$ represents an alkylene glycol chain where $n$ is selected from the group consisting of 2, 3 and 4 and $p$ is a number from 1 to 10; and salts thereof; and the cationic surfactant being a quaternary ammonium surfactant having the formula:

$$R_1R_2N^+(CH_3)_2X^-$$

wherein:

$R_1$ and $R_2$ are selected from the group consisting of alkyl and alkoxy-2-hydroxy propylene groups having from about six to about twenty-two carbon atoms; and X is an anion.

2. A detergent composition according to claim 1, in which the charge ratio is within the range from 0.70 to 0.95.

3. A detergent composition according to claim 1, in which the total amount of surfactant is within the range from about 5 to about 30% by weight.

4. A detergent composition according to claim 1, in which the nonionic surfactant has the formula:

$$RO(C_2H_4O)_xH$$

wherein

R is a hydrocarbon group selected from the group consisting of alkyl groups having from about eight to about twent-two carbon atoms, and mono-alkyl phenyl groups having a total of from about four to about twenty-four carbon atoms in the alkyl groups; and $x$ is a number from about 4 to about 40.

5. A detergent composition according to claim 1, consisting essentially of, in addition, an alkali metal polyphosphate in an amount within the range from 10 to about 50% by weight of the composition.

6. A detergent composition according to claim 1, consisting essentially of, in addition, an organic complexing agent selected from the group consisting of alkali metal, ammonium and organic amine salts of polyamino carboxylic acids, oxycarboxylic acids, and unsaturated polycarboxylic acids, in an amount within the range from about 5 to about 40% by weight of the composition.

7. A detergent composition according to claim 1, consisting essentially of, in addition, a soil-suspending agent selected from the group consisting of sodium carboxymethyl cellulose, sodium cellulose sulphate, ethyl hydroxyethyl cellulose, ethyl hydroxypropyl cellulose, hydroxyethyl cellulose, polyvinyl alcohol and polyvinyl pyrrollidone in an amount within the range from about 0.05 to about 5%, calculated on the amount of solids.

8. A detergent composition according to claim 1, in which the detergent composition is in liquid form, consisting essentially of, in addition, a solvent selected from the group consisting of water and water-soluble alcohols, polyols, and lower alkyl ether glycols having a low viscosity, in an amount within the range from about 10 to about 90% by weight of the detergent composition.

9. A detergent composition imparting a good antistatic effect and a good softening effect, consisting essentially of a mixture of surfactants of which a. from 30 to 90% by weight is a nonionic surfactant having the formula:

$$RA(C_nH_{2n}O)_xH$$

wherein

R is a hydrocarbon group selected from the group consisting of alkyl groups having from about eight to about twenty-two carbon atoms, and mono-alkyl phenyl groups having a total of from about four to about twenty-four carbon atoms in the alkyl groups; and A is selected from the group consisting of oxygen, sulfur, amido, carboxylic acid, sulfoxide and sulfonic groups;

$n$ is a number from 2 to 4; and $x$ is a number from 4 to about 40; and b. from 10 to 70% by weight is a surfactant mixture comprising at least one anionic surfactant and at least one cationic surfactant in a charge ratio anionic surfactant to cationic surfactant within the range from about 0.60 to about 0.98;

the anionic surfactant having the general formula:

$$R(OC_nH_{2n})_pOPO_2H \\ \quad\quad\quad\quad | \\ \quad\quad\quad\quad OR_1$$

wherein:

R is a hydrocarbon group selected from the group consisting of alkyl groups having from about eight to about twenty-two carbon atoms, and mono-alkyl-substituted phenyl groups having a total from about six to about eighteen carbon atoms in the alkyl groups;

$(OC_nH_{2n})_p$ represents an alkylene glycol chain where $n$ is selected from the group consisting of 2, 3 and 4 and $p$ is a number from 1 to 10;

$R_1$ represents hydrogen or any of the groups R and $R(OC_nH_{2n})_p$ defined above;

and salts thereof; and the cationic surfactant being a quaternary ammonium surfactant having the formula:

$$R_1R_2N^+(CH_3)_2X^-$$

wherein $R_1$ and $R_2$ are selected from the group consisting of alkyl and alkoxy-2-hydroxy propylene groups having from about six to about twenty-two carbon atoms; and X is an anion.

10. A detergent composition according to claim 9, in which the charge ratio is within the range from 0.70 to 0.95.

11. A detergent composition according to claim 9, in which the total amount of surfactant is within the range from about 5 to about 30% by weight.

12. A detergent composition according to claim 9, in which the nonionic surfactant has the formula:

$$RO(C_2H_4O)_xH$$

wherein

R is a hydrocarbon group selected from the group consisting of alkyl groups having from about eight to about twenty-two carbon atoms, and mono-alkyl phenyl groups having a total of from about four to about twenty-four carbon atoms in the alkyl groups; and $x$ is a number from about 4 to about 40.

13. A detergent composition according to claim 9, consisting essentially of, in addition, an alkali metal polyphosphate in an amount within the range from 10 to about 50% by weight of the composition.

14. A detergent composition according to claim 9, consisting essentially of, in addition, an organic complexing agent selected from the group consisting of alkali metal, ammonium and organic amine salts of polyamino carboxylic acids, oxycarboxylic acids, and unsaturated polycarboxylic acids, in an amount within the range from about 5 to about 40% by weight of the composition.

15. A detergent composition according to claim 9, consisting essentially of a soil suspending agent selected from the group consisting of sodium carboxymethyl cellulose, sodium cellulose sulphate, ethyl hydroxyethyl cellulose, ethyl hydroxypropyl cellulose, hydroxyethyl cellulose, polyvinyl alcohol and polyvinyl pyrrollidone in an amount within the range from about 0.05 to about 5%, calculated on the amount of solids.

16. A detergent composition according to claim 9, in which the detergent composition is in liquid form, and consists essentially of, in addition, a solvent selected from the group consisting of water and water-soluble alcohols, polyols, and lower alkyl ether glycols having a low viscosity, in an amount within the range from about 10 to about 90% by weight of the detergent composition.

* * * * *

UNITED STATES PATENT OFFICE

CERTIFICATE OF CORRECTION

Patent No. 4,058,489 Dated November 15, 1977

Inventor(s) Karl Martin Edvin Hellsten

It is certified that error appears in the above-identified patent and that said Letters Patent are hereby corrected as shown below:

Column 1, line 44 : "absorbed" should be --adsorbed--

Column 2, line 21 : Insert --the-- after "to" and before "nonionic"

Column 4, line 41 : " $RO(C_{p1}H_{2p_1}O)_{n1}(C_{p2}H_{2p_2}O)_{n2}(C_{p3}H_{2p_3}O)_{n3}CH_2CH(OH)CH_2N^+R_1R_2C_qH_{2q}COO^-$ " should be -- $RO(C_{p1}H_{2p_1}O)_{n1}(C_{p2}H_{2p_2}O)_{n2}(C_{p3}H_{2p_3}O)_{n3}CH_2CH(OH)CH_2N^+R_1R_2C_qH_{2q}COO^-$ --

Column 5, line 17 : "with" should be --within--

Column 7, line 60 : "potassiim" should be --potassium--

Column 9, line 1 : "option" should be --opinion--

Column 10, line 9 : "fabring" should be --fabric--

Column 12, Table VI : Eighth line up from bottom of table, insert a closed parenthesis [ )] after "sulfate"

Last line of table "(fabric from WKF) should be --(fabric from WFK)--

UNITED STATES PATENT OFFICE

CERTIFICATE OF CORRECTION

Patent No. 4,058,489 Dated November 15, 1977

Inventor(s) Karl Martin Edvin Hellsten

It is certified that error appears in the above-identified patent and that said Letters Patent are hereby corrected as shown below:

Column 14, line 13 : " $C_nH_{2n+1}(OC_2H_4)_pOCH_2CH_4$-$(OH)CH_2N^+(CH_3)_2CH_2COO^-$ " should be -- $C_nH_{2n+1}(OC_2H_4)_pOCH_2CH_4$-$(OH)CH_2N^+(CH_3)_2CH_2COO^-$ --

Column 15, line 20 : Insert a period (.) after "Example 1"

Signed and Sealed this

*Eighteenth* Day of *July 1978*

[SEAL]

*Attest:*

RUTH C. MASON
*Attesting Officer*

DONALD W. BANNER
*Commissioner of Patents and Trademarks*